US009536688B2

(12) United States Patent
Su

(10) Patent No.: US 9,536,688 B2
(45) Date of Patent: Jan. 3, 2017

(54) PRESS BUTTON DEVICE AND AUDIO EQUIPMENT HAVING THE PRESS BUTTON DEVICE

(71) Applicants: LITE-ON ELECTRONICS (GUANGZHOU) LIMITED, Guangzhou (CN); LITE-ON TECHNOLOGY CORP., Taipei (TW)

(72) Inventor: Chih-Hung Su, Taipei (TW)

(73) Assignees: Lite-On Electronics (Gaungzhou) Limited, Guangzhou (CN); Lite-On Technology Corp., Taipei (TW)

( * ) Notice: Subject to any disclaimer, the term of this patent is extended or adjusted under 35 U.S.C. 154(b) by 773 days.

(21) Appl. No.: 13/875,473

(22) Filed: May 2, 2013

(65) Prior Publication Data

US 2014/0072147 A1 Mar. 13, 2014

(30) Foreign Application Priority Data

Sep. 10, 2012 (CN) ..... 2012 1 0332816

(51) Int. Cl.
*H01H 13/50* (2006.01)
*H01H 13/06* (2006.01)
*H01H 13/52* (2006.01)

(52) U.S. Cl.
CPC ..... *H01H 13/50* (2013.01); *H01H 13/06* (2013.01); *H01H 13/52* (2013.01)

(58) Field of Classification Search
CPC ..... H01H 13/50
USPC ..... 200/345, 513, 5 A; 381/123
See application file for complete search history.

(56) References Cited

U.S. PATENT DOCUMENTS 4,677,268 A * 6/1987 Nemeth ..... H01H 13/702 200/513
5,194,703 A * 3/1993 Deeg ..... H01H 13/70 200/292
2004/0149560 A1* 8/2004 Sasaki ..... H01H 13/585 200/520
2009/0185698 A1* 7/2009 Liao ..... H04R 1/02 381/150
2010/0032277 A1* 2/2010 Anzai ..... H01H 13/48 200/513
2010/0072046 A1* 3/2010 Maeda ..... H01H 13/06 200/302.2
2012/0073943 A1* 3/2012 Tseng ..... H01H 13/703 200/5 A

* cited by examiner

*Primary Examiner* — Edwin A. Leon
*Assistant Examiner* — Iman Malakooti
(74) *Attorney, Agent, or Firm* — Rosenberg, Klein & Lee

(57) ABSTRACT

A press button device includes a button unit having a main body with a surrounding wall, and an actuating member protruding from an inner side of the main body for actuating a control switch. A flexible connection unit includes a button-coupling portion connected to the surrounding wall in an airtight manner, a fixed portion radially spaced apart from and surrounding the button-coupling portion, and a deformable portion interconnecting the button-coupling and fixed portions. The deformable portion is elastically displaced relative to the fixed portion when the button unit is pressed, and restores the button unit to its original position when the pressing force thereon is removed.

22 Claims, 9 Drawing Sheets

PRESS BUTTON DEVICE AND AUDIO EQUIPMENT HAVING THE PRESS BUTTON DEVICE

CROSS REFERENCE TO RELATED APPLICATION

This application claims priority of Chinese Patent Application No. 201210332816.5, filed on Sep. 10, 2012.

BACKGROUND OF THE INVENTION

1. Field of the Invention

The invention relates to a press button device, more particularly to a press button device that is integrally formed as one piece, that has an airtight, watertight, and anti-vibration function, and that is suitable for use in an audio equipment.

2. Description of the Related Art

A conventional audio equipment usually has a switch button for controlling the power on/off thereof by a user. An existing button is mostly mounted on a housing wall of a housing of the audio equipment. Since the button must be movable to facilitate a depressing stroke that will actuate a control switch, a gap is present between the button and the housing so that the button can move freely. To avoid affecting the sound quality, the housing of the audio equipment needs to be airtight and prevent vibration of the button. Currently, the most common practice is to dispose the control switch on a circuit board with a small area (hereinafter referred to as a small board) which is independent from a main circuit board. The small board and the control switch thereon are disposed in an independent space of the housing that is separated by a structure and that corresponds in position to the button. The independent space is isolated from a main space of the housing a sealant. Through this, the button is isolated from the main space during pressing, and the main space will not have air leakage caused by pressing the button.

However, such a practice not only requires constructing an additional design for an independent space, there is also a need to use sealant to isolate the independent space from the main space of the housing. Space design is susceptible to restriction, and the associated assembly process is complicated. Hence, an improvement is necessary.

SUMMARY OF THE INVENTION

Therefore, an object of the present invention is to provide a press button device that is directly mounted to a housing and that can achieve an airtight and watertight effect without using a sealing means.

Another object of this invention is to provide a press button device that is directly mounted to a housing and that can achieve an airtight, watertight and anti-vibration effect without using a sealing means.

Still another object of this invention is to provide an audio equipment having the aforesaid press button device.

According to one aspect of this invention, a press button device comprises a button unit and a flexible connection unit. The button unit includes a main body and an actuating member. The main body has a surrounding wall that has a closed end closed by a press end wall, and an open end portion opposite to the press end wall. The actuating member protrudes from an inner side of the main body for actuating a control switch. The flexible connection unit is made of a soft elastic material and includes a tubular button-coupling portion, an annular fixed portion and a deformable portion that are formed integrally as one piece. The button-coupling portion surrounds the open end portion of the surrounding wall and is connected to the surrounding wall in an airtight manner. The fixed portion is radially spaced apart from and surrounds the button-coupling portion. The deformable portion interconnects the button-coupling portion and the fixed portion. The deformable portion is elastically displaced relative to the fixed portion when the button unit is pressed, and restores the button unit to its original position when the pressing force thereon is removed.

According to another aspect of this invention, an audio equipment comprises a housing, a circuit module, a speaker module and a press button device. The housing has a housing wall (90) formed with a through hole. The circuit module is disposed in the housing and includes a circuit board and a control switch disposed on the circuit board. The control switch is located in proximity to the through hole to control the power on/off of the audio equipment. The speaker module is disposed in the housing and is electrically connected to the circuit module to reproduce sound. The press button device is fixed to the housing at a position corresponding to that of the control switch and includes a button unit and a flexible connection unit. The button unit has a main body and an actuating member. The main body is received movably in the through hole and has a surrounding wall that has a shape corresponding to that of the through hole and that has a closed end closed by a press end wall, and an open end portion opposite to the press end wall. The actuating member protrudes from an inner side of the main body to actuate the control switch. The flexible connection unit is made of a soft elastic material and includes a tubular button-coupling portion, an annular fixed portion and a deformable portion that are formed integrally as one piece. The button-coupling portion surrounds the open end portion of the surrounding wall and is connected to the surrounding wall in an airtight manner. The fixed portion is radially spaced apart from and surrounds the button-coupling portion, and abuts against an inner wall face of the housing wall that surrounds the through hole. The deformable portion interconnects the button-coupling portion and the fixed portion. The deformable portion is elastically displaced relative to the fixed portion when the button unit is pressed so as to move the actuating member to contact and actuate the control switch, and restores the button unit to its original position when the pressing force thereon is removed.

The efficiency of this invention resides in that the press button device is directly mounted to the housing and can achieve an airtight, watertight and anti-vibration effect without using a sealing means. This consequently simplifies an assembly process and saves manufacturing costs.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
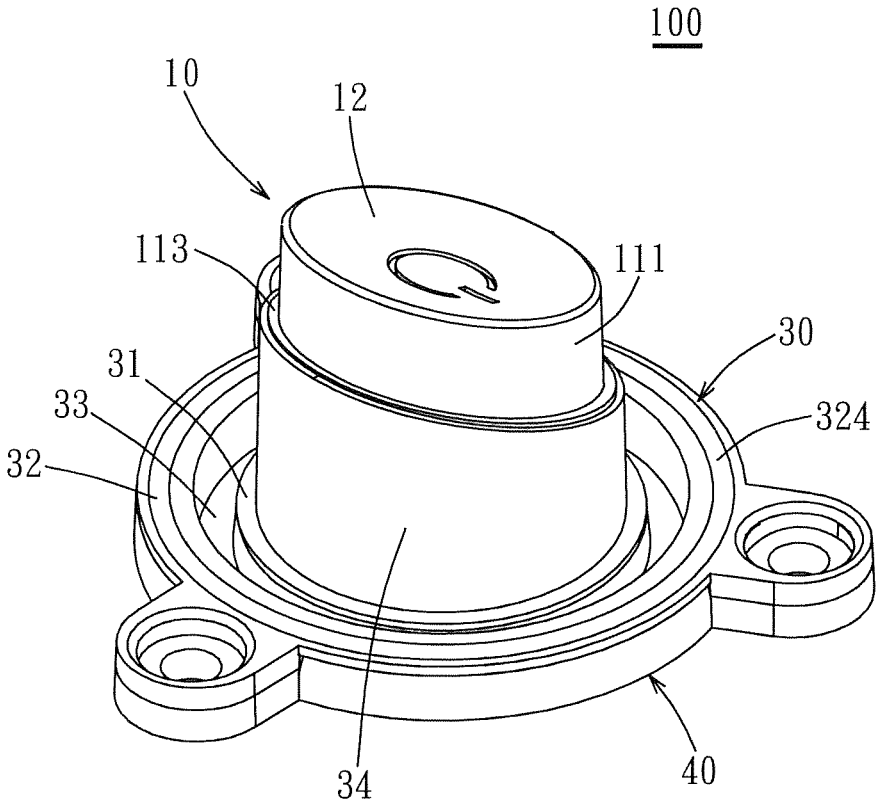
FIG. 1 is a perspective view of a press button device of an audio equipment according to the preferred embodiment of the present invention.

The above-mentioned and other technical contents, features, and effects of this disclosure will be clearly presented from the following detailed description of one preferred embodiment in coordination with the reference drawings.

Referring to FIGS. 1 to 4, a press button device 100 according to the preferred embodiment of the present invention is shown to comprise a button unit 10, a flexible connection unit 30 and a support unit 40.

The button unit 10 includes a main body 1 and an actuating member 2. The main body 1 has a surrounding wall 11 that has a closed end closed by a press end wall 12, and an open end portion opposite to the press end wall 12. The surrounding wall 11 has a small-diameter portion 111 connected to the press end wall 12, a large-diameter portion 112 having the open end portion, an annular stepped portion 113 formed between the small-diameter portion 111 and the large-diameter portion 112, and an annular flange 114 that extends outwardly and radially from a bottom periphery of the large-diameter portion 112. The actuating member 2 protrudes from an inner side of the main body 1, and partially projects out of the open end portion of the surrounding wall 11.

The flexible connection unit 30 is made of a soft elastic material, and includes a tubular button-coupling portion 35, a fixed portion 32 and a deformable portion 33 that are formed integrally as one piece. The button-coupling portion 35 is connected to the surrounding wall 11 in an airtight manner, and includes a tubular part 34 surroundingly covers the large-diameter portion 112 of the surrounding wall 11, and an annular shoulder part 31 extending outwardly and radially from a bottom periphery of the tubular part 34. The tubular part 34 has an anti-vibration function. The fixed portion 32 is radially spaced apart from and surrounds the button-coupling portion 35. The deformable portion 33 interconnects the button-coupling portion 35 and the fixed portion 32, and has a substantially U-shaped cross section. The deformable portion 33 includes an annular inner arm 331 extending axially from an outer periphery of the shoulder part 31 in a direction away from the tubular part 34, an intermediate section 333 having one end connected to the inner arm 331, and an annular outer arm 332 extending axially from the other end of the intermediate section 333 in a direction opposite to that of the inner arm 331. The intermediate section 333 is deformable between the button-coupling portion 35 and the fixed portion 32. The annular flange 114 abuts against the annular shoulder part 31 and the annular inner arm 331.

The fixed portion 32 has a ring body 321 extending outwardly and radially from one end of the outer arm 332 that is distal from the intermediate section 333, an annular projection 324 protruding from a surface of the ring body 321 in a direction similar to that of the outer arm 332, and a plurality of angularly spaced-apart lug portions 322 extending outwardly and radially from an outer periphery of the ring body 321. Each of the lug portions 322 has an aperture 323.

The support unit 40 is connected to the fixed portion 32, and is disposed opposite to the button-coupling portion 35 to provide rigidity to the fixed portion 32. Particularly, the support unit 40 has an annular body 41 corresponding in shape with the ring body 321 of the fixed portion 32 and disposed around the annular outer arm 332 of the deformable portion 33, and a plurality of lug portions 42 respectively corresponding in position to the lug portions 322 of the fixed portion 32. Each of the lug portions 42 has an aperture 43 aligned with the aperture 323 in the respective lug portion 322.

Figure 3:
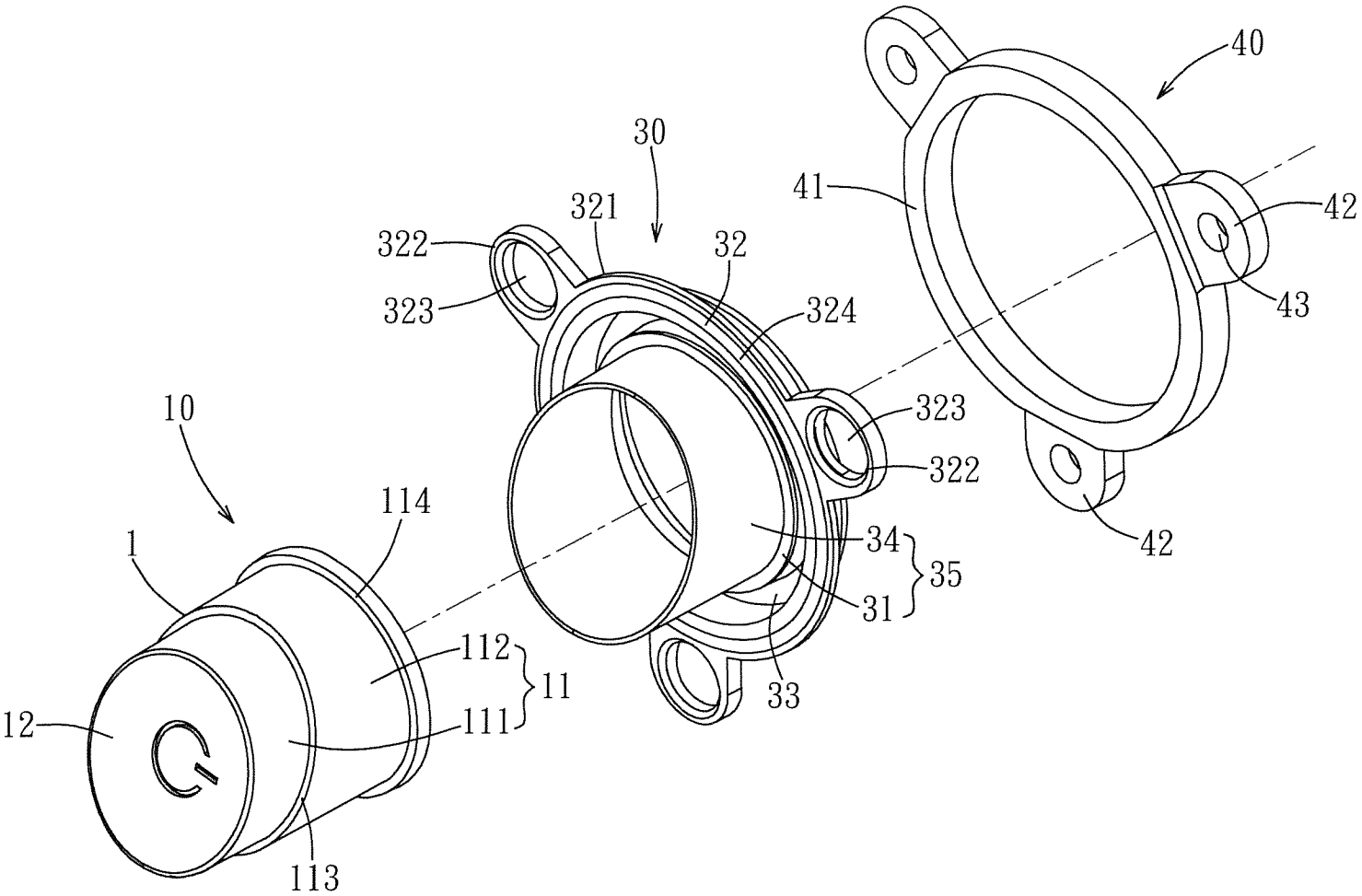
FIG. 3 is an exploded perspective view of the press button device.
Figure 4:
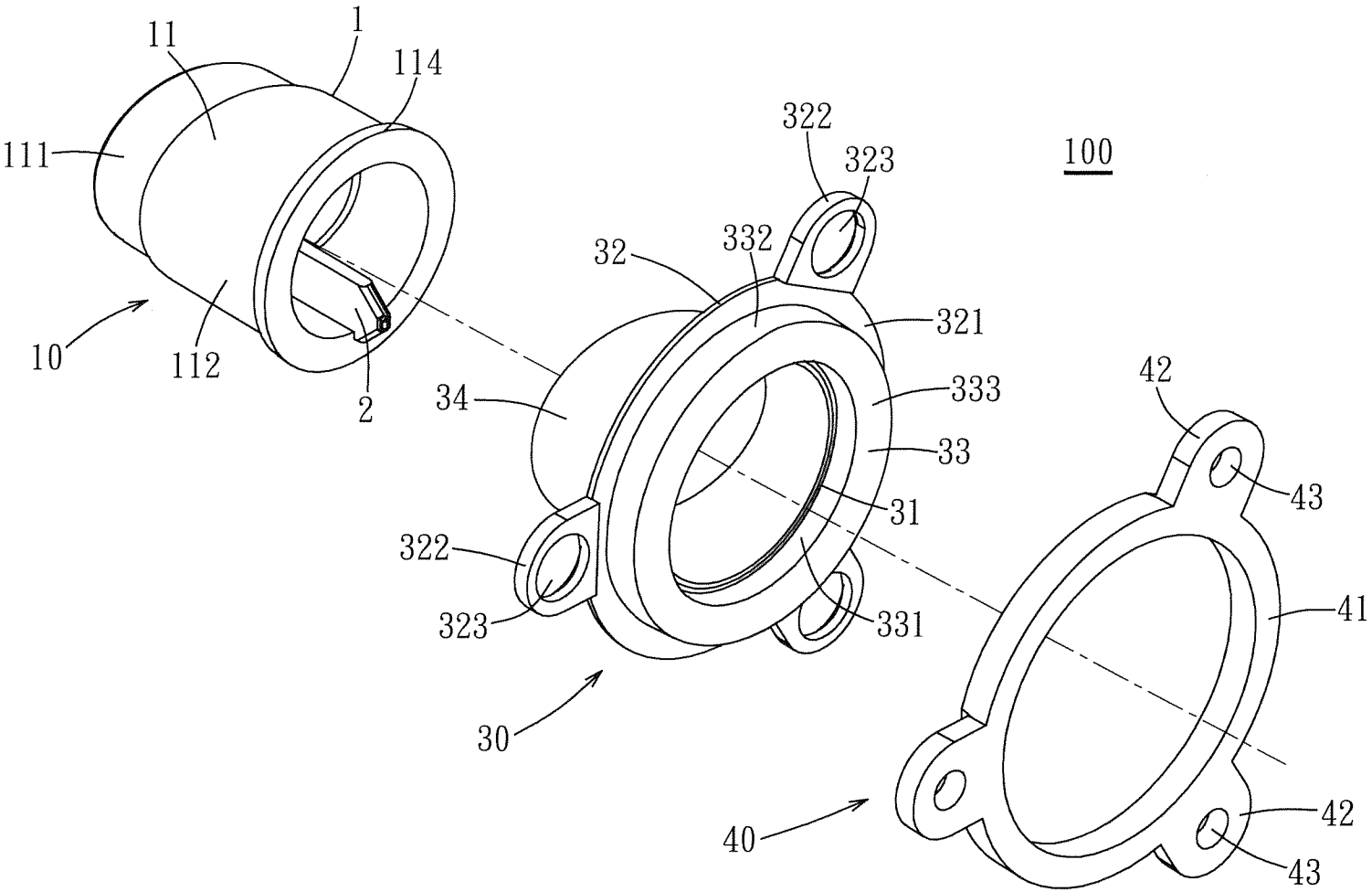
FIG. 4 is an exploded perspective view of the press button device taken from another angle.

In this embodiment, the flexible connection unit 30 is made of a thermoplastic elastomeric material, such as rubber, silicone, etc. The button unit 10 and the support unit 40 are made of a plastic material having rigidity. A plastic material that can be injection molded and that has a melting point higher than that of the material of the flexible connection unit 30 is preferable. The flexible connection unit 30, the button unit 10 and the support unit 40 are made through a double injection molding process. That is, an existing double injection molding technology is used. In an injection molding apparatus, the button unit 10 and the support unit 40 are first formed. The two may be formed using the same material. Afterwards, the flexible connection unit 30 is formed. During forming of the flexible connection unit 30, the flexible connection unit 30 is coupled fixedly to the button unit 10 and the support unit 40 so as to form integrally as one piece. FIGS. 3 and 4 illustrate the three components separately to facilitate description of the same. In actual practice, these three components cannot be dissembled.

Figure 2:
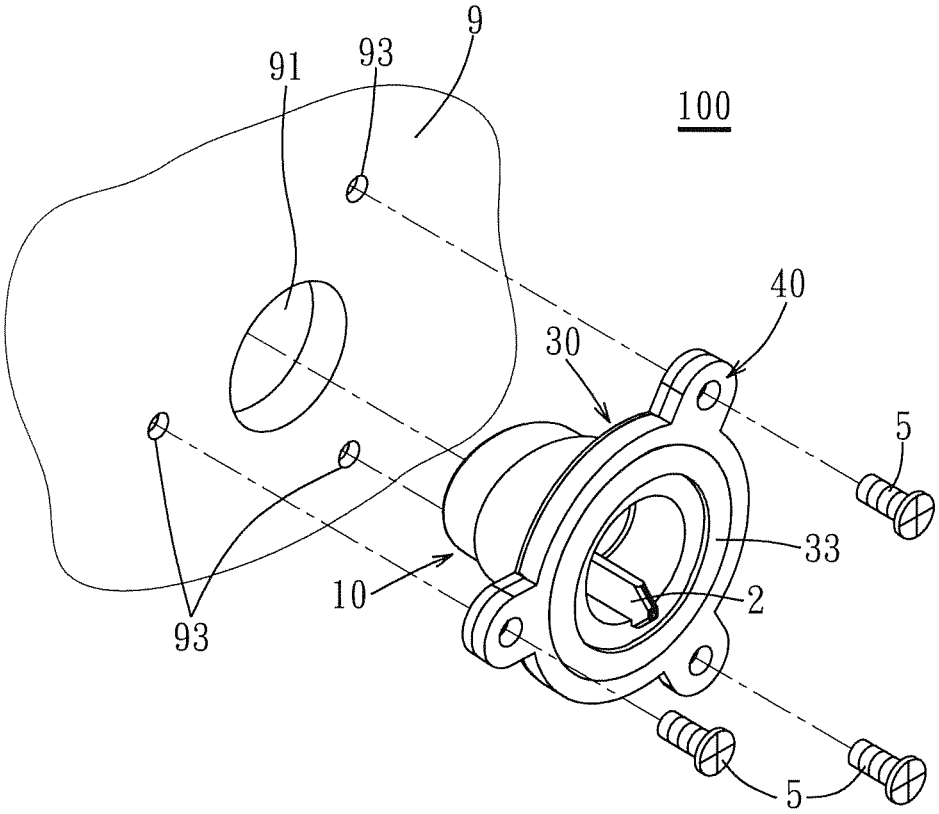
FIG. 2 is an exploded perspective view, illustrating how the press button device is mounted to a housing of the audio equipment.
Figure 5:
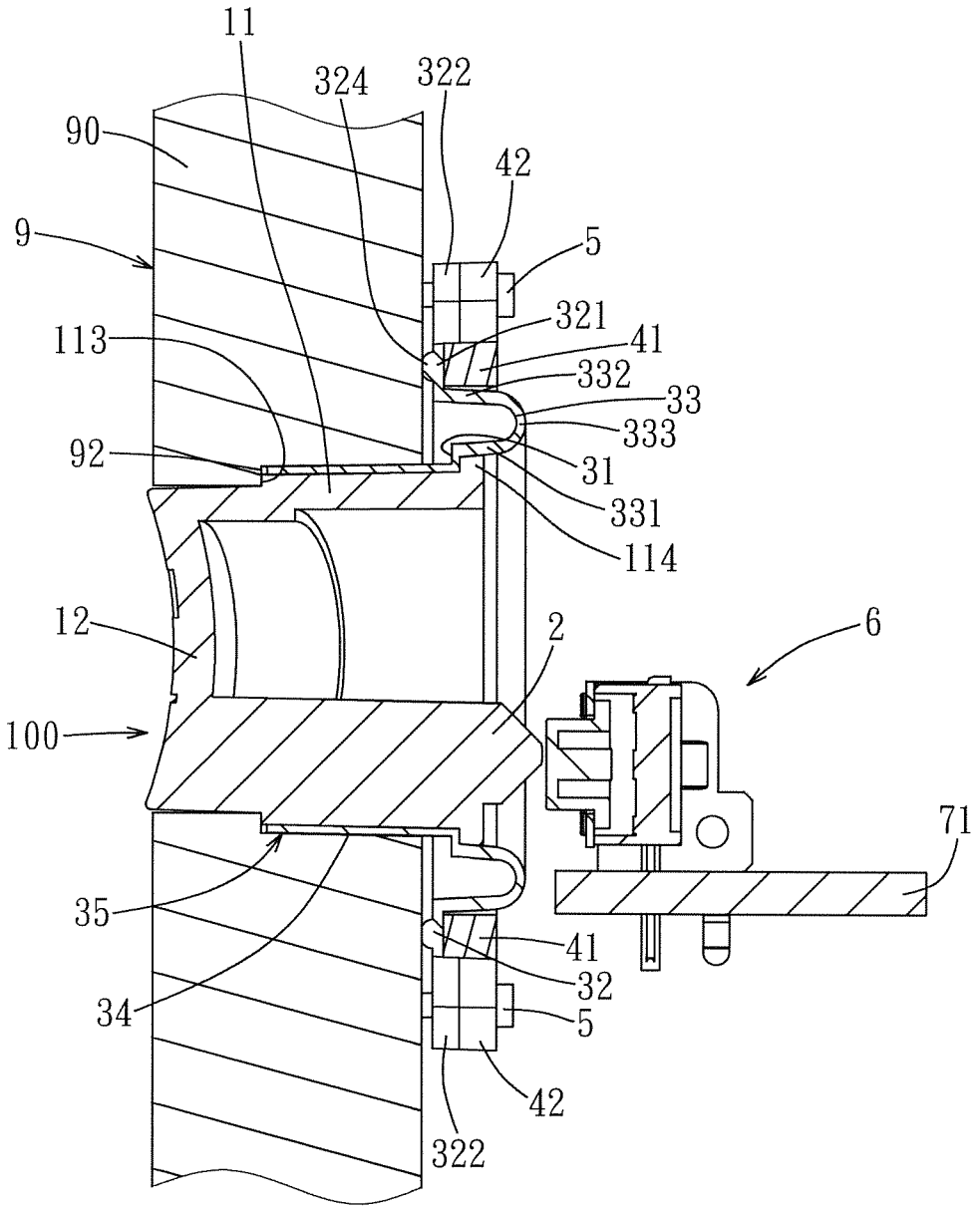
FIG. 5 is a sectional side view, illustrating an assembly relationship among the press button device, the housing and a control switch.

Referring to FIG. 5, in combination with FIGS. 1 to 3, the press button device 100 is inserted into a through hole 91 of a housing 9, which has a shape corresponding to that of the press button device 100, and is fixed to the housing 9 by extending a plurality of fasteners 5 through the respective apertures 43 in the lug portions 42 of the support unit 40 and the respective apertures 323 in the lug portions 322 of the fixed portion 32, and then engaging threadedly and respectively screw holes 93 in the housing 9. In this embodiment, the fasteners 5 are configured as screws. When the press button device 100 is received in the through hole 91 of the housing 9, the stepped portion 113 of the surrounding wall 11 abuts against a corresponding stepped portion 92 of the housing 9 to provide a stop function that prevents the surrounding wall 11 and the press end wall 12 from excessively protruding out of the housing 9. Furthermore, the fixed portion 32 is pressed by the support unit 40 to abut against a housing wall 90 of the housing 9 that surrounds the through hole 91. Because the annular projection 324 of the fixed portion 32 is elastically deformable and can abut against the housing wall 90 of the housing 9 in an airtight manner, and because the button-coupling portion 35 of the flexible connection unit 30 is connected to the surrounding wall 11 in an airtight manner, the through hole 91 can be sealed, so that an airtight and watertight function of the press button device 100 can be achieved. Furthermore, since the tubular part 34 of the button-coupling portion 35 of the flexible connection unit 30 has an anti-vibration function and covers a major portion of the surrounding wall 11, the press button device 100 can be prevented from vibration.

Figure 6:
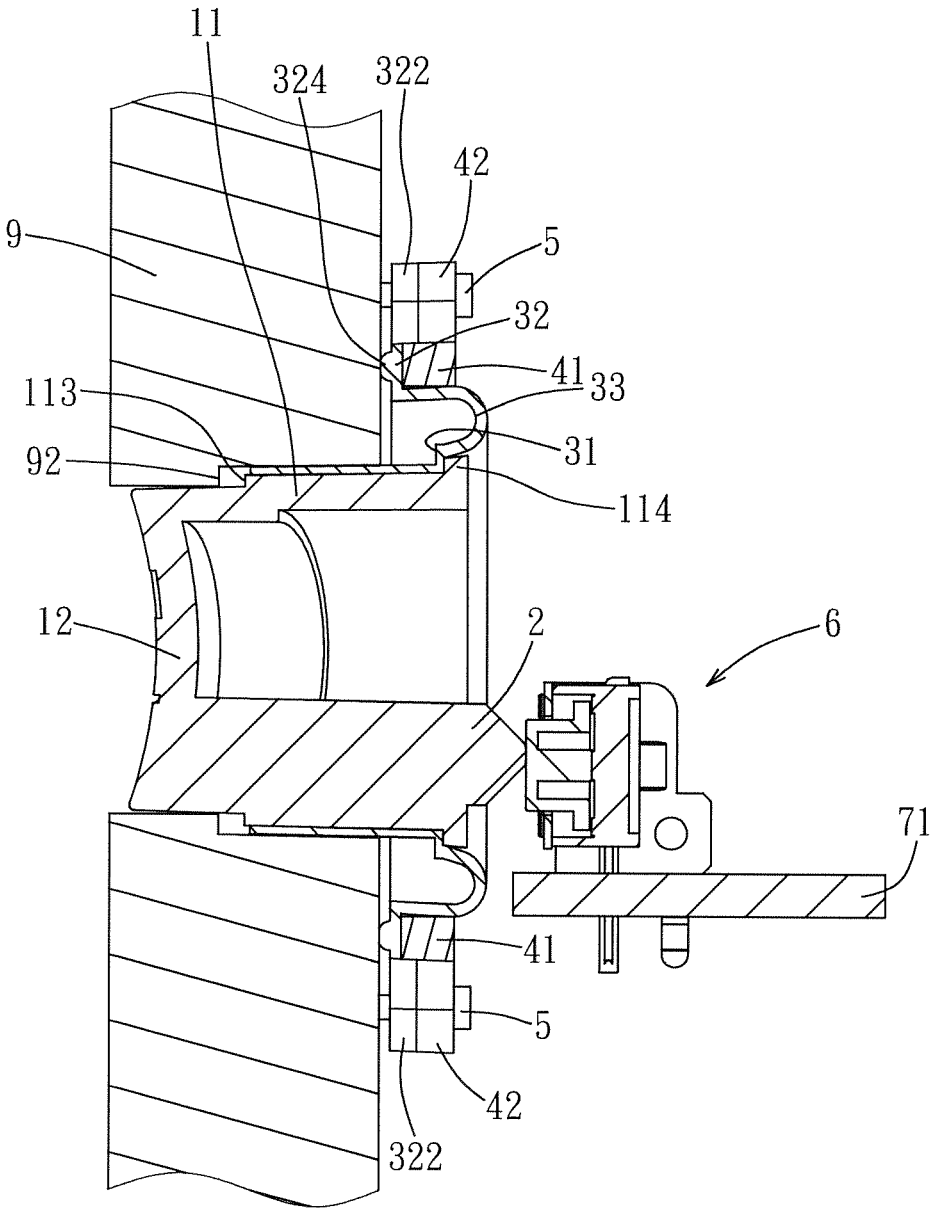
FIG. 6 is a view similar to FIG. 5, but illustrating the press button device in a pressed state.
Figure 7:
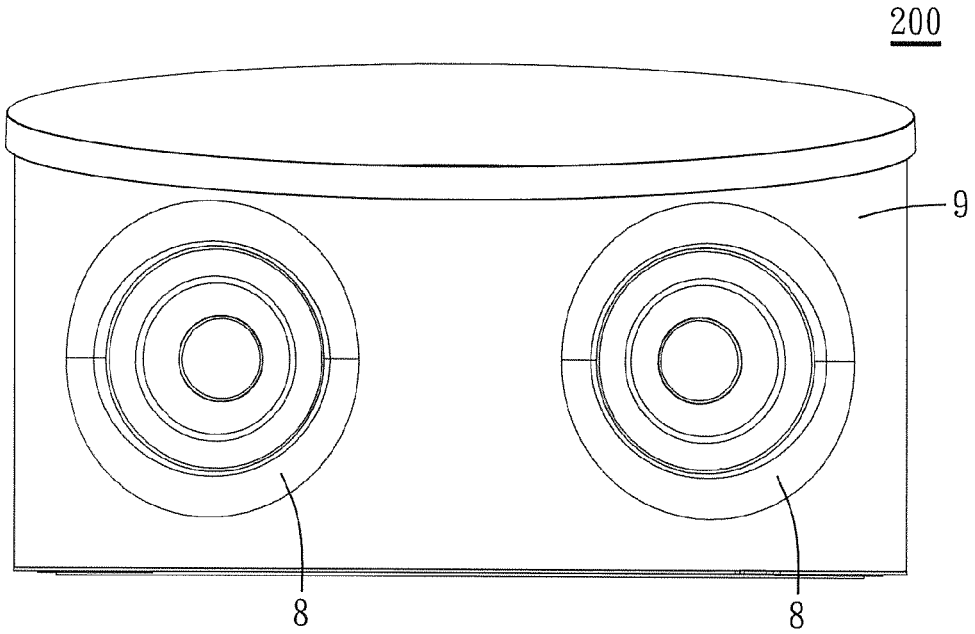
FIG. 7 is a schematic front view of the audio equipment of the preferred embodiment.
Figure 8:
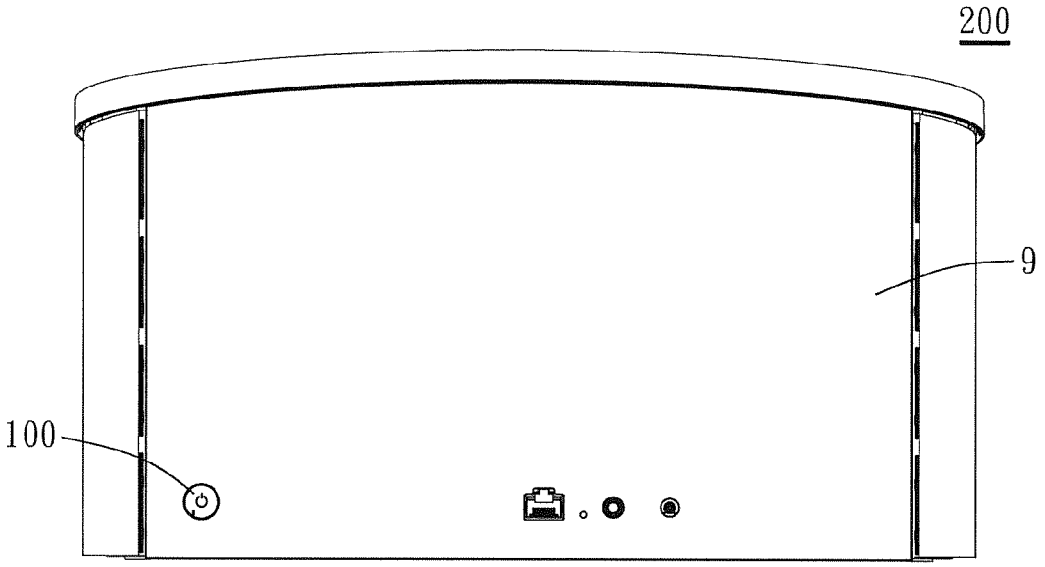
FIG. 8 is a schematic rear view of the audio equipment of the preferred embodiment.
Figure 9:
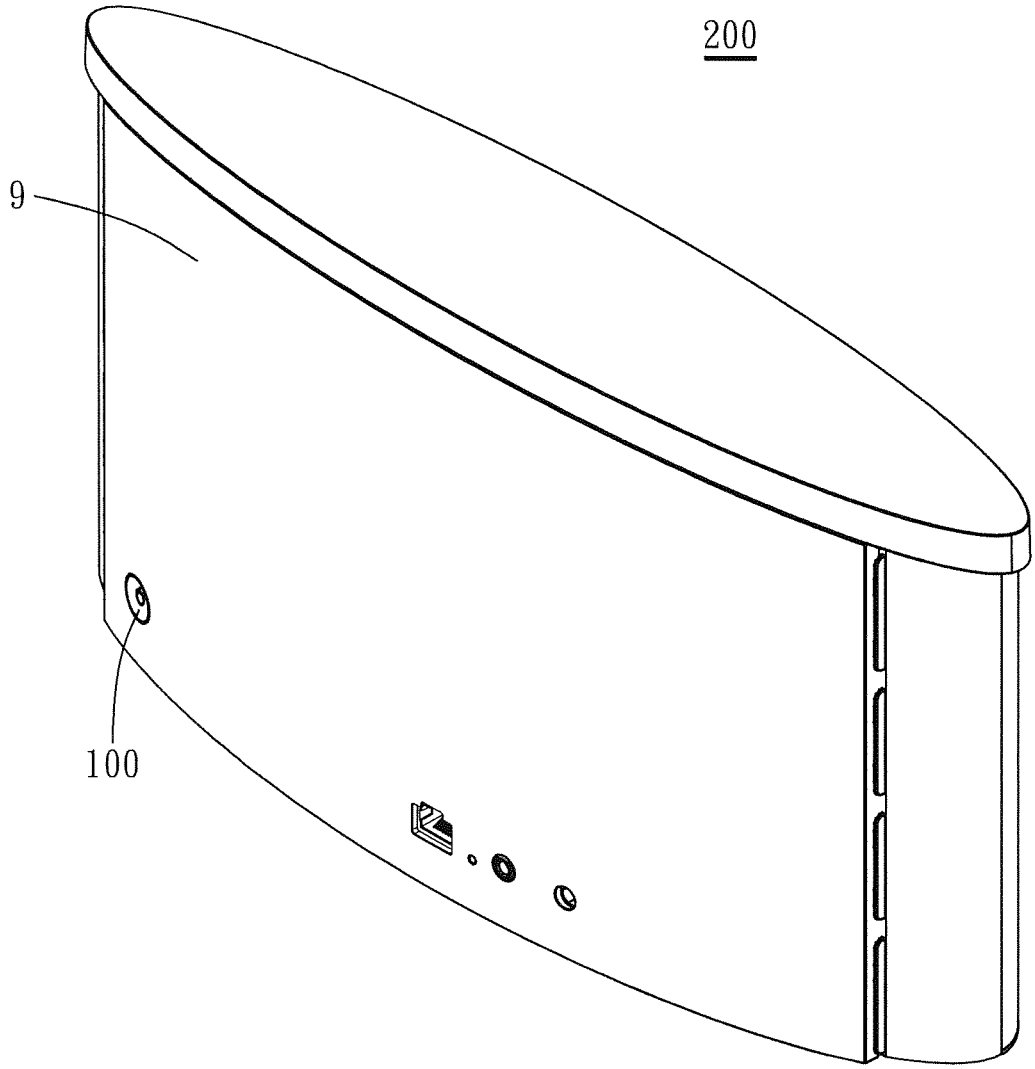
FIG. 9 is a perspective view of the audio equipment of the preferred embodiment.
Figure 10:
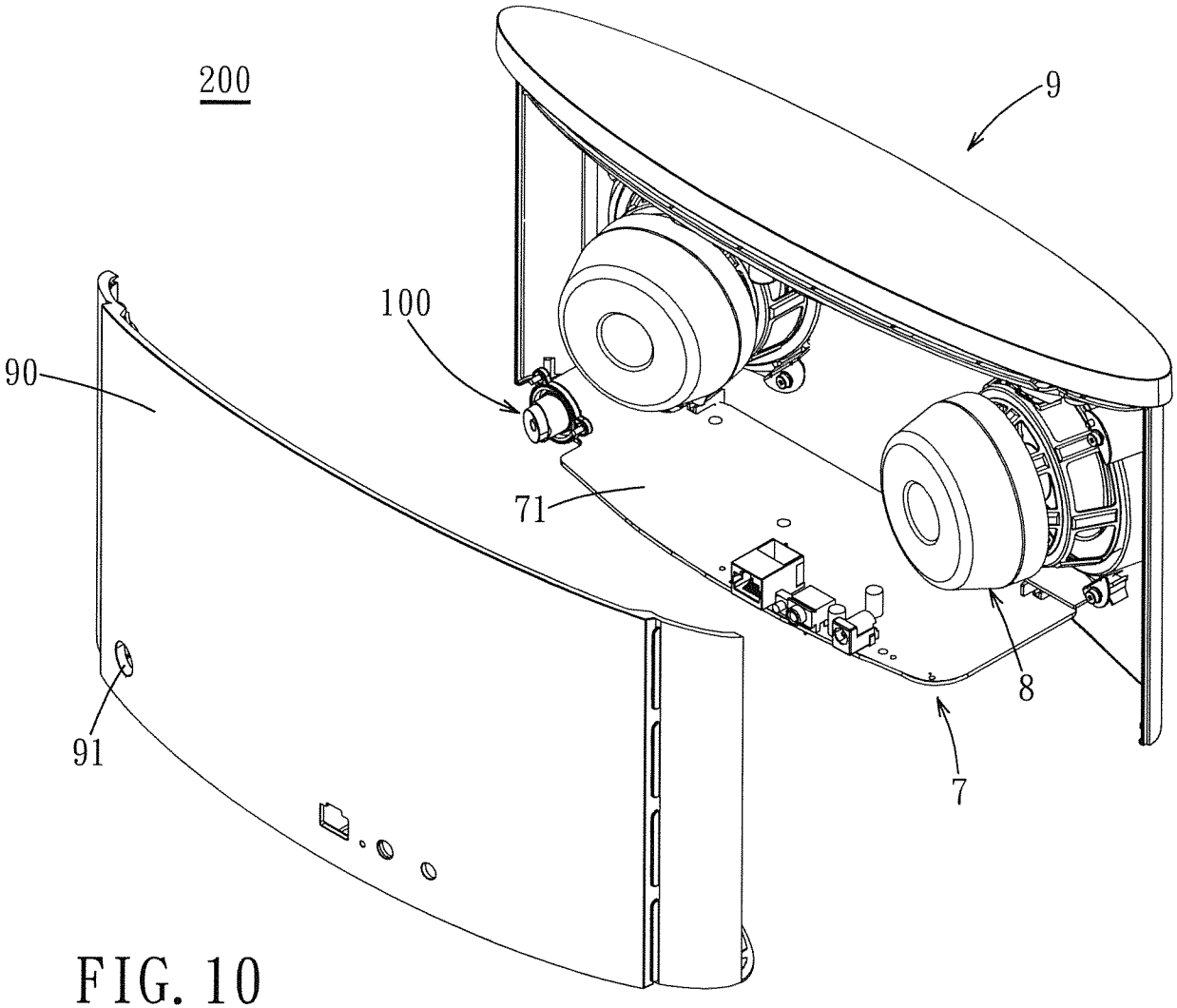
FIG. 10 is a view similar to FIG. 9, but with a housing wall of the housing of the audio equipment being removed to permit viewing of an internal structure of the audio equipment.

Referring to FIG. 6, in combination with FIG. 5, since the actuating member 2 of the press button device 100 is disposed in a position corresponding to that of a control switch 6, when the press end wall 12 is pressed with force, the button unit 10 is moved into the housing 9 so that the actuating member 2 can contact and actuate the control switch 6. During movement of the button unit 10 into the housing 9, the surrounding wall 11 moves the button-coupling portion 35 therealong, and the button-coupling portion 35, in turn, pushes the deformable portion 33. Because the fixed portion 32 is fixed to the housing 9, the deformable portion 33 is elastically displaced relative to the fixed portion 32. When the pressing force on the press end wall 12 is removed, the button unit 10 is restored to its original position through a restoring force of the deformable portion 33 for the next pressing operation. In other words, the deformable portion 33 of the flexible connection unit 30 is elastically displaced relative to the fixed portion 32 when the button unit 10 is pressed, and restores the button unit 10 to its original position when the pressing force thereon is removed.

Referring to FIGS. 7 to 10, the press button device 100 is applied to an audio equipment 200. In this embodiment, the audio equipment 200 comprises the housing 9, a circuit module 7 and a speaker module 8. The housing 9 has the housing wall 90 formed with the through hole 91. The circuit module 7 is disposed in the housing 9, and includes a circuit board 71. The control switch 6 (see FIGS. 5 and 6) is disposed on the circuit board 71, and is located in proximity to the through hole 91 to control the power on/off of the audio equipment 200. The speaker module 8 is disposed in the housing 9, and is electrically connected to the circuit module 7 to reproduce sound. The press button device 100 is received in the through hole 91, and is fixed to the housing wall 90 at a position corresponding to that of the control switch 6. Since the installation of the press button device 100 and the relation between the press button device 100 and the control switch 6 are as described above, a detailed description thereof is omitted herein. By pressing the press button device 100, the audio equipment 200 can be turned on or off.

Because the press button device 100 is directly mounted to the housing 9 and can achieve an airtight, watertight and anti-vibration function without using any sealing means, when applied to the audio equipment 200, the trouble to construct an independent space and isolate it from a main space of the housing by using a sealant can be eliminated. Further, because there is no need to construct an independent space, the control switch 6 can be mounted directly to the housing 9, instead of the small board as in the case of the conventional practice. Hence, an assembly process of this invention can be simplified to a large extent and the manufacturing costs thereof can be saved. Additionally, the press button device 100 is watertight, so that it may also be applied to other electronic device (not shown) that requires an airtight or watertight function.

The press end wall 12 of the main body 1 of the button unit 10 In this embodiment is inclined so as to correspond to the curvature of a surface of the housing wall 90 of the housing 9. Alternatively, it may be adjusted according to the applied housing. The shape of the press end wall 12 is not particularly limited.

In sum, an airtight, watertight and anti-vibration function can be achieved by directly mounting the press button device 100 on the housing 9. This consequently simplifies significantly the assembly process and saves the manufacturing costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A press button device comprising:

a button unit including a main body and an actuating member, said main body having a surrounding wall that has a closed end closed by a press end wall, and an open end portion opposite to said press end wall, said actuating member protruding from an inner side of said main body for directly actuating a control switch; and a flexible connection unit made of a soft elastic material and including a tubular button-coupling portion, an annular fixed portion and an annular deformable portion that are formed integrally as one piece, said button-coupling portion surrounding said open end portion of said surrounding wall and being connected to said surrounding wall in an airtight manner to be movable therewith, said fixed portion being radially spaced apart from and surrounding said button-coupling portion, said annular deformable portion interconnecting said button-coupling portion and said fixed portion;

wherein said deformable portion is elastically displaced relative to said fixed portion when said button unit is pressed, and restores said button unit to its original position when the pressing force thereon is removed.

2. The press button device as claimed in claim 1, further comprising a support unit that is connected to said fixed portion and that is disposed opposite to said button-coupling portion to provide rigidity to said fixed portion.

3. The press button device as claimed in claim 1, wherein said actuating member partially projects out of said open end portion of said surrounding wall.

4. The press button device as claimed in claim 1, wherein said flexible connection unit is made of a thermoplastic elastomeric material.

5. The press button device as claimed in claim 4, wherein said button unit is made of a plastic material and has rigidity, and said flexible connection unit and said button unit are made through a double injection molding process.

6. The press button device as claimed in claim 2, wherein said flexible connection unit is made of a thermoplastic elastomeric material, said button unit and said support unit are made of a plastic material and have rigidity, and said flexible connection unit, said support unit and said button unit are made through a double injection molding process.

7. A press button device comprising:

a button unit including a main body and an actuating member, said main body having a surrounding wall that has a closed end closed by a press end wall, and an open end portion opposite to said press end wall, said actuating member protruding from an inner side of said main body for directly actuating a control switch;

a flexible connection unit made of a soft elastic material and including a tubular button-coupling portion, an annular fixed portion and an annular deformable portion that are formed integrally as one piece, said button-coupling portion surrounding said open end portion of said surrounding wall and being connected to said surrounding wall in an airtight manner, said fixed portion being radially spaced apart from and surrounding said button-coupling portion, said annular deformable portion interconnecting said button-coupling portion and said fixed portion; and a support unit connected to said fixed portion and disposed opposite to said button-coupling portion to provide rigidity to said fixed portion;

wherein said deformable portion is elastically displaced relative to said fixed portion when said button unit is pressed, and restores said button unit to its original position when the pressing force thereon is removed; and wherein said button-coupling portion includes a tubular part surrounding said open end portion of said surrounding wall, and an annular shoulder part extending outwardly and radially from a bottom periphery of said tubular part, said deformable portion including an annular inner arm extending axially from an outer periphery of said shoulder part in a direction away from said tubular part, an intermediate section having one end connected to said inner arm, and an annular outer arm extending axially from the other end of said intermediate section in a direction opposite to said inner arm, said intermediate section being deformable between said button-coupling portion and said fixed portion, said support unit being disposed around said outer arm, said fixed portion having a ring body extending outwardly and radially from one end of said outer arm that is distal from said intermediate section, and an annular projection protruding from said ring body in a direction similar to that of said outer arm.

8. The press button device as claimed in claim 7, wherein said fixed portion further has a plurality of angularly spaced-apart lug portions extending outwardly and radially from an outer periphery of said ring body, each of said lug portions having an aperture for an extension of a fastener there through.

9. The press button device as claimed in claim 7, wherein said surrounding wall has an annular flange that extends outwardly and radially from a bottom periphery of said open end portion and that abuts against said shoulder part of said button-coupling portion and said inner arm of said deformable portion.

10. The press button device as claimed in claim 7, wherein said surrounding wall has a small-diameter portion connected to said press end wall, a large-diameter portion having said open end portion, and an annular stepped portion formed between said small-diameter portion and said large-diameter portion.

11. The press button device as claimed in claim 10, wherein said tubular part of said button-coupling portion surroundingly covers said large-diameter portion.

12. An audio equipment comprising:

a housing having a housing wall formed with a through hole;

a circuit module disposed in said housing and including a circuit board and a control switch disposed on said circuit board, said control switch being located in proximity to said through hole to control the power on/off of said audio equipment;

a speaker module disposed in said housing and electrically connected to said circuit module to reproduce sound; and a press button device fixed to said housing at a position corresponding to that of said control switch and including:

a button unit having a main body and an actuating member, said main body being received movably in said through hole and having a surrounding wall that has a shape corresponding to that of said through hole that has a closed end closed by a press end wall, and an open end portion opposite to said press end wall, said actuating member protruding from an inner side of said main body to directly actuate said control switch; and a flexible connection unit made of a soft elastic material and including a tubular button-coupling portion, an annular fixed portion and an annular deformable portion that are formed integrally as one piece, said button-coupling portion surrounding said open end portion of said surrounding wall and being connected to said surrounding wall in an airtight manner to be movable therewith, said fixed portion being radially spaced apart from and surrounding said button-coupling portion and abutting against an inner wall face of said housing wall that surrounds said through hole, said deformable portion interconnecting said button-coupling portion and said fixed portion;

wherein said deformable portion is elastically displaced relative to said fixed portion when said button unit is pressed so as to move said actuating member to contact and actuate said control switch, and restores said button unit to its original position when the pressing force thereon is removed.

13. The audio equipment as claimed in claim 12, wherein said press button device further includes a support unit that is connected to said fixed portion and that is disposed opposite to said button-coupling portion to provide rigidity to said fixed portion.

14. The audio equipment as claimed in claim 13, wherein said button-coupling portion includes a tubular part surrounding said open end portion of said surrounding wall, and an annular shoulder part extending outwardly and radially from a bottom periphery of said tubular part, said deformable portion including an annular inner arm extending axially from an outer periphery of said shoulder part in a direction away from said tubular part, an intermediate section having one end connected to said inner arm, and an annular outer arm extending axially from the other end of said intermediate section in a direction opposite to said inner arm, said intermediate section being deformable between said button-coupling portion and said fixed portion, said support unit being disposed around said outer arm, said fixed portion having a ring body extending outwardly and radially from one end of said outer arm that is distal from said intermediate section, and an annular projection protruding from said ring body in a direction similar to that of said outer arm.

15. The audio equipment as claimed in claim 14, wherein said fixed portion further has a plurality of angularly spaced-apart lug portions extending outwardly and radially from an outer periphery of said ring body, each of said lug portions having an aperture for an extension of a fastener there-through.

16. The audio equipment as claimed in claim 14, wherein said surrounding wall has an annular flange that extends outwardly and radially from a bottom periphery of said open end portion and that abuts against said shoulder part of said button-coupling portion and said inner arm of said deformable portion.

17. The audio equipment as claimed in claim 14, wherein said surrounding wall has a small-diameter portion connected to said press end wall, a large-diameter portion having said open end portion, and an annular stepped portion formed between said small-diameter portion and said large-diameter portion.

18. The audio equipment as claimed in claim 17, wherein said tubular part of said button-coupling portion surroundingly covers said large-diameter portion.

19. The audio equipment as claimed in claim 12, wherein said actuating member partially projects out of said open end portion of said surrounding wall.

20. The audio equipment as claimed in claim 12, wherein said flexible connection unit is made of a thermoplastic elastomeric material.

21. The audio equipment as claimed in claim 20, wherein said button unit is made of a plastic material and has rigidity, and said flexible connection unit and said button unit are made through a double injection molding process.

22. The audio equipment as claimed in claim 13, wherein said flexible connection unit is made of a thermoplastic elastomeric material, said button unit and said support unit are made of a plastic material and have rigidity, and said flexible connection unit, said support unit and said button unit are made through a double injection molding process.

* * * * *